US011987756B2

(12) United States Patent
Sun et al.

(10) Patent No.: US 11,987,756 B2
(45) Date of Patent: May 21, 2024

(54) PROCESS FOR PVC-CONTAINING MIXED PLASTIC WASTE PYROLYSIS IN A REACTOR HANDLING THREE PHASES OF PRODUCTS

(71) Applicant: UOP LLC, Des Plaines, IL (US)

(72) Inventors: Ping Sun, Hinsdale, IL (US); Pengfei Chen, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 383 days.

(21) Appl. No.: 17/524,326

(22) Filed: Nov. 11, 2021

(65) Prior Publication Data

US 2022/0204861 A1 Jun. 30, 2022

Related U.S. Application Data

(60) Provisional application No. 63/132,573, filed on Dec. 31, 2020.

(51) Int. Cl.
*C10G 1/00* (2006.01)
*C10G 1/10* (2006.01)

(52) U.S. Cl.
CPC ..... *C10G 1/002* (2013.01); *C10G 1/10* (2013.01); *C10G 2300/1003* (2013.01); *C10G 2300/202* (2013.01); *C10G 2300/4006* (2013.01); *C10G 2300/4012* (2013.01); *C10G 2300/4018* (2013.01)

(58) Field of Classification Search
CPC .. C10G 1/002; C10G 1/10; C10G 2300/1003; C10G 2300/202; C10G 2300/4006; C10G 2300/4012; C10G 2300/4018
See application file for complete search history.

(56) References Cited

U.S. PATENT DOCUMENTS 6,084,139 A 7/2000 Van Der Giessen et al.

FOREIGN PATENT DOCUMENTS

JP 09085046 A 7/1993
KR 20050019432 A 3/2005

OTHER PUBLICATIONS

"International Search Report and Written Opinion for PCT/US2021073196", dated Mar. 17, 2022.

*Primary Examiner* — Thuan D Dang
(74) *Attorney, Agent, or Firm* — Paschall & Associates, LLC; Mark Goldberg

(57) ABSTRACT

A process for pyrolysis of a mixed plastic stream that contains polyvinyl chloride (PVC) is provided in which the chloride from PVC is removed from an initial melting reactor that melts the mixed plastic stream. Chloride is removed in a vapor stream from the initial melting reactor with additional chloride removed from addition of sorbents to the pyrolysis reactor and in adsorbent beds downstream of the pyrolysis reactor. The pyrolysis reactor has a configuration comprising two cylindrical ring structures, an inner cylindrical ring structure within an outer cylindrical ring structure wherein a circulation liquid supply stream enters said pyrolysis reactor tangentially relative to a ring edge of said two cylindrical ring structures and wherein solid particles move in a downward direction to a bottom of the pyrolysis reactor.

16 Claims, 5 Drawing Sheets

PROCESS FOR PVC-CONTAINING MIXED PLASTIC WASTE PYROLYSIS IN A REACTOR HANDLING THREE PHASES OF PRODUCTS

This application claims priority from U.S. application 63/132,573, filed on Dec. 31, 2020 which is incorporated herein in its entirety.

FIELD

The general field is the pyrolyzing of a plastic waste stream into hydrocarbons while minimizing the amount of mixed plastic sorting that is required. Particularly, the disclosure relates to a low temperature non-stirred well-mixed pyrolysis reactor.

BACKGROUND OF THE INVENTION

Mixed plastic waste originates from curbside waste collection of post-consumer plastic waste. Mixed plastic waste also comes from specific industrial sites e.g., construction, packaging and agricultural wastes that have a broad range of compositions. Chemical recycling by pyrolysis process is known to convert plastic waste to a fuel or petrochemical feedstock substitute under an air-free atmosphere and higher temperature conditions, e.g., 350° C. to 900° C.

In despite of variations in mixed plastic feed, mixed plastic waste broadly defined contains comingled plastics of all seven types, i.e. polyethylene terephthalate (PET), low-density and high-density polyethylene (PE), polypropylene (PP), polyvinyl chloride (PVC), polystyrene (PS) and other miscellaneous plastics coming from a variety of post-consumer products, e.g., electronic waste, automobile waste, polyurethane foam packaging, carpet nylon, etc. Other impurities such as trace metals as compounding additives to enhance performance from polymerization processes may exist in mixed feed waste. In addition, small amounts of non-plastics such as paper and wood may also exist.

Certain plastics produce higher yields of char, a carbonaceous solid. Char is known to have significant deactivation effects on heterogenous catalyst. U.S. Pat. No. 6,255,547B1 is an example which describes a heterogeneous catalyst used to pyrolyze plastics. Heterogeneous catalysts are prone to fast catalytical deactivation from pyrolysis conditions and are prone to deactivating interference from byproducts. In particular, there is interference from coating or pore blocks at catalyst surface by char. EP2516592B1 described a method of minimizing the interference using a catalyst by adopting a batch-mode mechanical stirred reactor. The batch reactor removes char from the bottom of the reactor after each reaction cycle. Batch operation in many circumstances is undesired. Operators requires multiple reaction trains to avoid production interruption in batch operation, and schedules become complex. Batch operation can also contribute to variations in product quality over time unless a large number of parallel trains are used in a staggered schedule. Operating in this way adds both capital and operating cost. Pyrolysis without catalysis is more efficiently and economically done in a continuous matter.

Prior art taught plastic waste pyrolysis by using a rotary kiln (US20170283706A1, US201702182786A1) or extrusion equipment (U.S. Ser. No. 10/233,393). Transport of the products, including char, may involve operating the rotary kiln at a certain rotary speed, or utilizing an auger-type device. Most commonly, heat is transferred indirectly through the reactor wall by fuel gas firing, electrical heating or a hot oil medium. Heat transfer into reactants relies on the coefficient of conductivity between the wall and reactants. This results in a large temperature gradient in the reactor. The process fluid near the wall is much hotter than the process fluid away from the heated wall. The net effect is excessive char yield originating from the fluid near the hotter wall. Uniform heat distribution in the reactor should result in lower char yields, and higher product yields.

Use of convective heat transfer in the pyrolysis reactor helps avoid the issues with indirect heating discussed as mentioned above. This is typically done by circuiting a process stream and heating it through an external heater or an exchanger so that it acts as a heating medium for the reactor (US20140114098A1). The circulating heat medium may thermally crack however, which creates complications with selection of the heating fluid. The plastic itself also has a low thermal conductivity which means that a larger amount of heat medium may be required. US20140114098A1 disclose a use of a crude oil as a heat transfer aid to overcome low thermal conductivity of the melted plastic feed. Crude oil and its distillation fractions are known to crack significantly at the temperatures seen in the pyrolysis reactor. This means that a continuous supply of crude oil is required. This poses a practical challenge when such a supply is difficult to obtain and adds extra cost to the process. A process stream is a better choice of heating medium as it solves this sourcing issue. The circulated process-derived product stream must be free of large metal solids and large char solids to avoid heater fouling and exchanger fouling. Through novel reactor design, a pyrolysis pumparound stream can have its solid content minimized so that the stream is not erosive or fouling, and can supply the heating medium requirements.

In a continuously operated, well-mixed reactor system, metal species from the feed, e.g., iron, copper, aluminum containing residue in a variety of molecule, any heterogeneous catalyst or performance-enhancing sorbent or larger carbonaceous char particles may lead to shortened run time in heater tubes or/and circulation pumps due to erosion and particularly due to fouling and thus transfer line plugging. It is preferred to remove such solid particles, including metal species from the feed, any heterogeneous catalyst or performance-enhancing sorbent or larger carbonaceous char particles. Metal species, e.g., iron, copper, aluminum may be higher in density, in 2-3-fold in values than sorbent and carbonaceous char particles, therefore much easier to settle down to a reactor bottom and leave the process. However, there is a need to design a system that direct sorbent and carbonaceous char particles that can cause plugging issues to settle down to reactor bottom.

Accordingly, there is a need for a robust process that handles mixed plastic, especially one that minimizes the amount of sorting of plastic feed. The reactor system should run continuously and effectively settle metal and char particles for a smooth process operation while utilizing a process stream to maintain high heat transfer efficiency to the reactor. In particular, it can be advantageous to employ a reactor that does not need to have a physical mixer, but instead relies upon the velocity of the streams to provide the necessary mixing.

BRIEF SUMMARY

Various embodiments contemplated herein relate to processes and apparatuses for pyrolyzing a mixed plastic waste stream to produce a low chloride content oil product. The exemplary embodiments taught herein provide a process for pyrolyzing a mixed plastic waste stream. The embodiments also illustrate a novel reactor design which helps enable the aforementioned process.

In accordance with an exemplary embodiment, a process for pyrolyzing a mixed plastic waste stream is provided. The process comprises pyrolyzing a minimally sorted mixed plastic waste stream. The waste plastics first contact a hot liquid stream that is produced from the process in a melting reactor. This melting reactor melts the waste plastics and produces a vapor stream which is described in further detail later herein. The bottoms liquid from the melting reactor may be pumped or pressured into a pyrolysis reactor where the melting reactor bottoms stream is cracked into a vapor stream and a bottoms liquids stream. The pyrolysis reactor contains a significant inventory of liquid material produced in the polymerization reactor. This liquid mixes with the melting reactor bottoms liquid to provide all heat of reaction and heat of vaporization needed at both the melting reactor and the pyrolysis reactor. The hot liquid stream flows through a tangential jet into the pyrolysis reactor top ring area via a pumping device. The hot liquid stream has a higher temperature than the main reactor as it provides all of the heat needed for the pyrolysis reactor. The pyrolysis reaction produces char particles that settle along the circular wall area down to the pyrolysis reactor bottom. Any metal particles and large char particles are collected and are discharged along the pyrolysis reactor bottoms liquids stream. A portion of the reactor liquid is removed and sent to a pumparound pump. A portion of the circulating liquid is sent through a heater system where all heat needed to sustain the main cracking reaction is provided. At least a portion of the circulating liquid from the heating system is directly sent to the melting reactor to sustain melting reaction needs.

The process utilizes a novel reactor design to provide a method for continuous pyrolysis operation and solid separation despite using the minimally sorted mixed plastic feed.

These and other features, aspects, and advantages of the present disclosure will become better understood upon consideration of the following detailed description, drawings and appended claims.

BRIEF DESCRIPTION OF THE DRAWINGS

The various embodiments will hereinafter be described in conjunction with the following FIGURES, wherein like numerals denote like elements.

FIG. 3 including

DEFINITIONS

Figure 1:
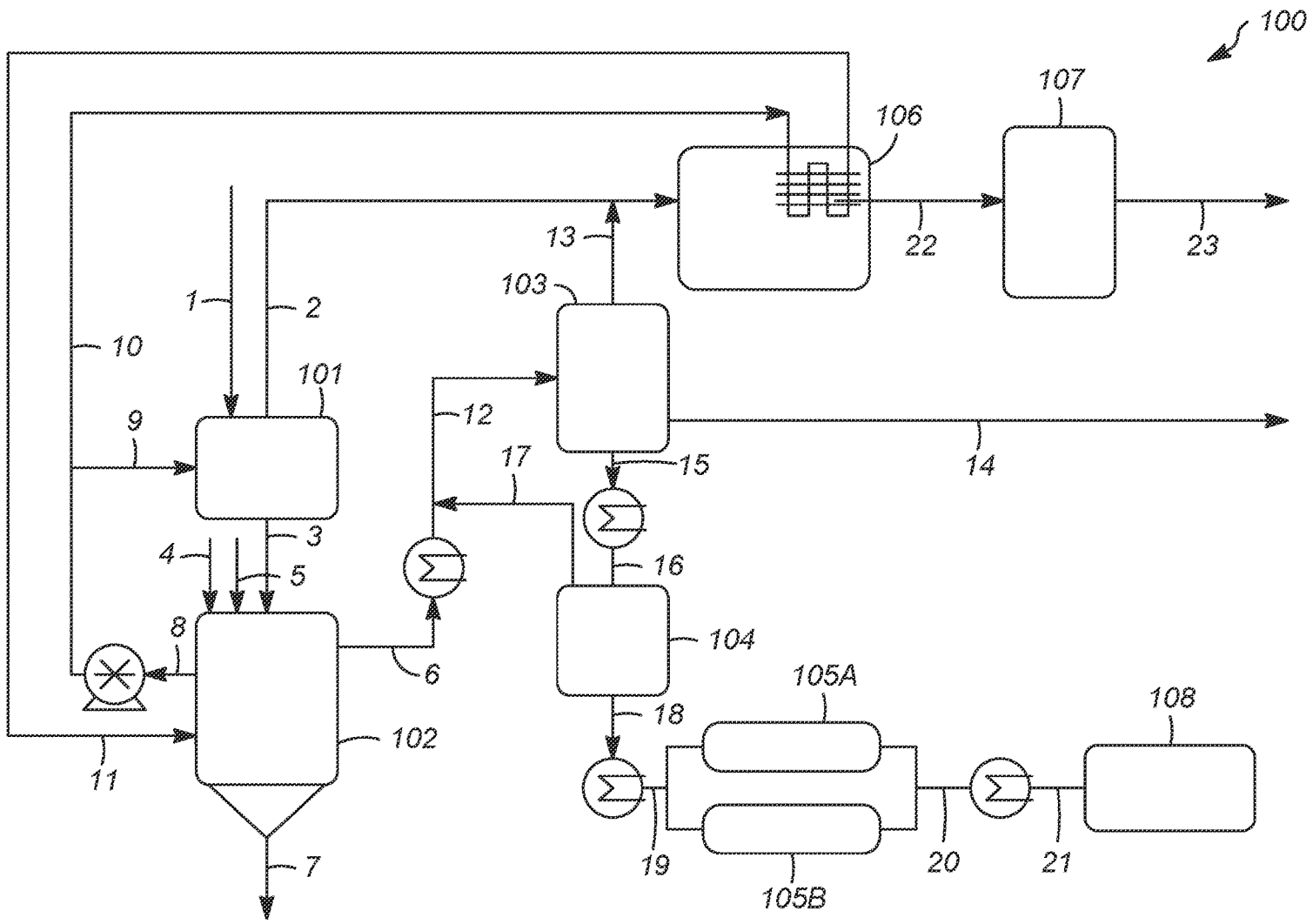
FIG. 1 is a schematic diagram of a process and an apparatus for pyrolyzing a mixed plastic stream in accordance with an exemplary embodiment.

As used herein, the term "reactor" means a thermal cracking vessel that provides residence time for feed polymers. The melting tank reactor is a reactor where only a portion of a mixed plastic feed is pyrolyzed when the majority of the mixed plastic feed goes through physical melting into a viscous liquid. The main pyrolysis reactor types are introduced above, a well-mixed reactor type of using convective heat transfer has advantages over indirectly conductivity heater transfer offered by a kiln or a screw extruder. Well-mixed reactor sees uniform temperature distribution established throughout the liquid space.

As used herein, the term "mixed plastic feed" means two or more polymers are present in the feed.

As used herein, the term "product" means a portion of mass stream, after the pyrolysis reaction. A product can be broad as main products that may be sold for profit, a stream that is a byproduct when aiming for the main profitable product. In the current context, the pyrolysis reaction produces residue gaseous product containing a hydrocarbon gas, in 5-10% wt of the melt feed, a liquid when condensed to room condition in 70-90 wt % of yield, 2-15% wt of a residue that leaves from reactor discharge as a mix of liquid and solid that may not have high profit such as it is considered as a byproduct.

As used herein, the term "residue" means a portion remaining after a process step. In the current context, a residue is specifically a stream that leaves the process boundary as a mix of liquid and solid that has relatively lower profitable use to downstream applications than the main product.

As used herein, the term "char" is a solid material remaining after a plastic feed stream has been pyrolyzed. A char is a carbonaceous byproduct that is commonly embedded in a residue stream. A char is a necessary byproduct when making main product. A reaction strategy may be applied to reduce char, but it cannot be eliminated. Certain plastic compositions contribute to yielding char in higher amount than another. It is known that rigid plastic and aromatic molecule containing plastic compounds, such as PVC, PET, PS or acrylonitrile butadiene styrene from electronic waste tend to make more char than polyethylene and polypropylene at comparable processing conditions.

As used herein, the term "solids" are materials in a solid state. As mentioned above, the mixed plastic may contain layered additives introduced during polymer manufacturing processes. One example is MgO, CaO and $Li_2O$ based glass fiber species. Another example is zinc, lead or cadmium based metallic fillers when forming conductive plastics. Metal or alkali metal ends up in the residue stream in a solid format. Another form of solids may come from a sorbent that is useful for reacting chloride-containing molecules when in reaction. Examples include a calcium-based sorbent in hydroxide, oxides or its carbonates, frequently from a naturally occurring mineral. Thirdly there is the above-mentioned solid is carbonaceous char in agglomerated format. Large char particles if carried into pump or a heater, settle in transfer lines and continue to foul these lines to cause flow interruption and poor heat transfer. It may also gum up pump gears or blades and lead to an extended interruption. Large char particles here refer to size. A solid/liquid segregation is related to its density and particle sizes. Frequently a Stokes' law and its derivatives are used to predict its behavior when transporting in a liquid. The solids properties for metal, or alkali metal, alkaline earth metals are denser than a carbonaceous solid, char thus are easier to settle down to the bottom of a reactor for discharge. Char is more of a challenge to be selectively settled due to its lower density. The difficulties are more severe when a certain smaller particle size cut of char is intended to settle. For solid density, the particle density for metal, or alkali metal, alkaline earth metals are frequently between 2-5 g/cc. A char particle may have a particle density of 1.25-1.8 g/cc. A char particle with large than ~150 micro meter in size may be considered more harmful to contribute to foulants.

As used herein, the term "portion" means an amount or part taken or separated from a main stream without any change in the composition as compared to the main stream. Further, it also includes splitting the taken or separated portion into multiple portions where each portion retains the same composition as compared to the main stream.

As used herein, the term "unit" can refer to an area including one or more equipment items and/or one or more sub-units. Equipment items can include one or more reactors or reactor vessels, heaters, separators, drums, exchangers, pipes, pumps, compressors, and controllers. Additionally, an equipment item, such as a reactor, dryer, or vessel, can further include one or more units or sub-units.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" or "directly" means that flow from the upstream component enters the downstream component without undergoing a compositional change due to physical fractionation or chemical conversions used herein, the term "settling". Settling refers to a solid and liquid separation, specifically having solids travel downward to or within a reactor vessel. When a solid tends to settle, its carrier liquid cannot provide the velocity as it is needed to continue to accelerate or prevent it from dropping off from a continuous spectrum of liquid flow solely by liquid-solid drag force. The critical liquid velocity is frequently known as "terminal velocity" or "settling velocity". When a solid settles, it has a slip velocity from liquid average velocity, or it falls behind. When this occurs to a swarm of solid, solids tend to build up concentrations in a gradient due to lag in solid transport or form a sediment when liquid travels in a pipe or a vessel. Further when density difference is smaller between solids and fluid, centrifugal principle can be applied to enhance the separation. Thus, a centrifugal device, such as a hydrocyclone separation is known to be able to enhance solid separation, seemingly like thickening solid concentration along the wall down to the very bottom of the device, while clear, solid-lean liquid turns back to device top, thus completing the separation, like solid settling. As used herein, the term "quality". Pyrolysis product quality refers to many chemical compositions that make it more or less suitable to a downstream application. In pyrolysis of a mixed plastic, an objective of pyrolysis is frequently to apply it to downstream refinery. Its hydrocarbon content is important measure of quality. In particular, a key quality measure relevant to this invention is chloride content. The chloride content, either in organic or inorganic format tends to lead to metallurgy corrosion.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description. The figures have been simplified by the deletion of a large number of apparatuses customarily employed in a process of this nature, such as vessel internals, temperature and pressure controls systems, flow control valves, recycle pumps, etc. which are not specifically required to illustrate the performance of the process. Furthermore, the illustration of the current process in the embodiment of a specific drawing is not intended to limit the process to specific embodiments set out herein.

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

A two-step mixed plastic waste pyrolysis process for pyrolyzing a polyvinyl chloride containing waste stream with a metal and char product is provided. The process for pyrolyzing a plastic waste stream is addressed with reference to a process and an apparatus 100 according to an embodiment as shown in FIG. 1. Referring to FIG. 1, the process and apparatus 100 comprise a melting reactor 101, a pyrolysis reactor 102, separation units 103 and 104, an adsorbent bed section 105, a waste gas burning and oil heat exchanger section (also referred to as incinerator) 106, a gas cleaning section 107 and finally a product designation section that has optional fractionation and storage 108.

In an embodiment, the mixed plastic residue stream may comprise miscellaneous plastic waste comprising at least seven types of plastic classes, polyethylene terephthalate, low-density and high-density polyethylene, polypropylene, polyvinyl chloride, polystyrene and other miscellaneous plastics. The US Environmental Protection Agency reported in Advancing Sustainability Material Management: 2016 and 2017 Tables and Figures shows on US average that 3% polyvinyl chloride, 13% polyethylene terephthalate, 7% polystyrene and 11% other plastic and undefined ended up in 2017 waste plastic mix going to landfills. Relative amounts of each plastic type vary depending on the location of collection of recycled plastic.

Other miscellaneous plastics may originate from a variety of post-consumer products, including, acrylonitrile butadiene styrene found in electronic waste, polyurethane foam packaging, carpet nylon and polysulfone. The mixed plastic residue stream is also commonly known as containing impurities such as paper, wood, aluminum foil, some metallic conductive fillers or halogenated or non-halogenated flame retardants. During a pyrolysis reaction, some of these impurities may contribute to heteroatoms in product streams. Among all heteroatom in main products chloride originated from polyvinyl chloride is the most concerning for quality due to its link to metallurgy corrosion. Some contribute to more char formation due to the aromatic structure in polymer molecules. Some decompose out of the plastic molecular matrix and form particulate byproduct containing metals and alkaline earth metals.

In an embodiment, the mixed plastic waste at the processing end of a mechanical recycling facility (MRF) that is otherwise sent to a landfill is used for pyrolysis feedstock. In FIG. 1, the mixed feed stream is received with minimal sorting at the MRF site and is added in the system as a densified flake or a pellet. Mixed feed stream 1 is added to melting reactor 101. When mixed plastic waste is being pyrolyzed, 1 wt % polyvinyl chloride produces ~5800 ppmw hydrogen chloride in theory on a fresh feed rate basis. A mixed feed stream with minimal sorting may contain >2% wt PVC in it. Cold mixed plastic fluff mixes with a hot liquid stream 8 to reach a temperature of 300-350° C.

The melting reactor 101 functions as a dechlorination reactor and may operate at a temperature from about 200° C. (392° F.) to about 350° C. (662° F.), or preferably about 280° C. (536° F.) to about 320° C. (608° F.), a pressure from about 0.069 MPa (gauge) (10 psig) to about 1.38 MPa (gauge) (200 psig), or preferably about 0.138 MPa (gauge) (20 psig) to about 0.345 MPa (gauge) (50 psig), a liquid hourly space velocity of the fresh melt feed from about 0.1 $hr^{-1}$ to about 2 $hr^{-1}$, or preferably from about 0.2 $hr^{-1}$ to about 0.5 $hr^{-1}$, and under a nitrogen blanket or a dedicated nitrogen sweeping rate of about 1.7 $Nm^3/m^3$ (10 scf/bbl) to about 170 $Nm^3/m^3$ of plastic melt (1,000 scf/bbl), or preferably about 17 $Nm^3/m^3$ (100 scf/bbl) to about 850 $Nm^3/m^3$ plastic melt (500 scf/bbl) In the melting reactor 101 polyvinyl chloride is mostly pyrolyzed through an "unzipping" reaction where chloride molecules are easily removed through a pyrolysis free radical reaction and abstract hydrogen in nearby sites to form hydrogen chlorides. The temperature of the melting reactor 101 is selected to melt the majority of plastic components yet barely reach their cracking temperature to maximize yield of hydrogen chlorides and minimize the amount of reactive olefins formed. Melting reactor is equipped with a mixer to keep the plastic melt well mixed until melting is the mostly complete. The melting reactor may still leave a fraction of feed chloride unconverted. This chloride requires a few downstream steps to meet product quality requirement. A reasonable dechlorination conversion efficiency in the melting reactor is 90%, or from around 80 to around 98% within conditions specified above. Any organochlorides left in the melting reactor bottoms lead to the formation of hydrogen chloride in the pyrolysis reactor, so organochlorides and any hydrogen chloride trapped in pyrolysis oil is detrimental to downstream processing unit metallurgy and requires additional sorbent addition. In this invention, the product quality target is less than 10 ppmw chloride or less regardless of chloride content in the feed.

The melting reactor forms a first vapor stream 2 and a first liquid stream 3 from feed 1. The first liquid stream 3 contains a mixed plastic melt, with most of chloride removal in vapor stream 2. First liquid stream 3 is sent to the main pyrolysis reactor 102. The main pyrolysis reactor provides enough residence time for all mixed plastic to convert first liquid stream 3 to a designated product slate. The main pyrolysis reactor may operate at a temperature from about 300° C. (572° F.) to about 550° C. (1022° F.), or preferably about 380° C. (716° F.) to about 450° C. (842° F.), a pressure from about 0.069 MPa (gauge) (10 psig) to about 1.38 MPa (gauge) (200 psig), or preferably about 0.138 MPa (gauge) (20 psig) to about 0.345 MPa (gauge) (50 psig), a liquid hourly space velocity of the fresh melt feed from about 0.1 $hr^{-1}$ to about 2 $hr^{-1}$, or from about 0.2 $hr^{-1}$ to about 0.5 $hr^{-1}$ more preferably, and under nitrogen blanket or a dedicated nitrogen sweeping stream 4 at a rate of about 17 $Nm^3/m^3$ (100 scf/bbl) to about 850 $Nm^3/m^3$ plastic melt (5,000 scf/bbl), or about 170 $Nm^3/m^3$ (1000 scf/bbl) to about 340 $Nm^3/m^3$ plastic melt (2000 scf/bbl) more preferably. Nitrogen sweeping stream 4 serves as a dilution to hydrogen chloride partial pressure in total vapor product. Lowered hydrogen chloride partial pressure significantly reduces formation of organochloride by reducing the equilibrium constant. A finely ground solid sorbent stream 5 may be introduced to the feed at the top of the pyrolysis reactor 102. Sorbents chosen may include naturally occurring alkaline materials, e.g. calcium carbonate, quick lime, or calcium hydroxide. Calcium dosage is ideally in a 2-3 molar ratio to the chlorides left in the pyrolysis reactor feed. The previous dechlorination step in melting reactor 101 should have removed at least 80 wt % of the chloride in the mixed plastic feed. The alkaline sorbent dosage is based on the feed chloride content and the estimated chloride removal efficacy. Calcium may also have a flocculation effect, making carbonaceous char particles agglomerate around seeding of calcium particles. The flocculated particles will settle more easily in the pyrolysis reactor than unflocculated char particles. The pyrolysis reactor contains liquid in phase equilibrium with the vapor product stream. A portion of the liquid stream 8 may be sent to a circulation pump. The pumped stream may be split off to stream 9 and stream 10. The mass flow of stream 9 may be such that it sustains the melting reactor temperature as described above by mixing with the melted plastic. Stream 9 also may serve to reduce the polymer melt viscosity. The mass flow of stream 10 may be such that it obtains all of the enthalpy requirements via the heater 106 when returning to pyrolysis reactor 102 through stream 11. Necessary heat transfer is achieved by mixing hot stream 11 and cold stream 3 in main pyrolysis reactor 102. The pyrolysis reactor 102 may draw a second vapor product stream 6 from the top of the pyrolysis reactor and a second solid rich product stream 7 from the bottom of the reactor. Convective heat transfer inside pyrolysis reactor 102 along with mixing from pumping around stream 11 provides uniform heating, an advantage over pyrolysis reaction methods heated via external indirect heating, commonly seen in extrusion or rotary kiln reactors.

FIG. 1 further illustrates vapor product flow 6, which contains a range of hydrocarbons carried by a nitrogen flow at a designed vapor linear velocity. In this invention, the linear vapor velocity is intended be greater than 0.2 inch/second to avoid secondary cracking. Vapor product flow 6 may contact a cooling medium directly or indirectly and then be separated to a vapor stream 13 and a liquid stream 15. When direct water contact is involved as one possible cooling methods, an aqueous stream is collected at stream 14. When direct water contact is omitted, stream 14 may not exist. The liquid stream 15 is further a heated stream 16 and flashed in flash drum 104 to produce a stabilized liquid stream 18. The vapor stream 17 is at a higher pressure than separator 103 and is pressured back to separator 103 to enhance recovery of hydrocarbons in the desired product. The stream is mixed with stream 12 to avoid needing multiple inlet nozzles on separator 103.

The stabilized liquid stream 19 is further cooled to a desired temperature in stream 19 before it enters an adsorbent system 105. The adsorbent system 105 runs as a further and final chloride polishing device. Calcium, other alkaline materials or a range of naturally occurring adsorbents may be used to continuously remove a large fraction of the unconverted chloride content in the condensed oil. More preferably specially engineering adsorbents with high adsorbent capacity and activity are used. Adsorbent capacity is defined as per unit of adsorbent. Adsorbent activity is defined with a lower temperature required to achieve a desired rate. Further a Honeywell UOP commercial product CLR 204 is particularly suitable for this application. As previously mentioned herein, this disclosure provides for stepwise chloride removal. Single step chloride removal may have efficiency issues in chloride removal when a mixed plastic feed has elevated PVC content, e.g., 2% or more. Melting reactor 101 first removes over 80% by weight of chloride in the mixed plastic feed by decomposing the PVC in the melting reactor. This chloride is removed as hydrogen chloride. A fraction of the remaining chloride is removed in pyrolysis reactor 102 where a sorbent is added to convert a fraction of the chloride as a salt. Unconverted hydrogen chloride is further diluted in a sweeping nitrogen flow where gas-phase recombination reactions between hydrogen chloride and organic molecules are minimized. The steps mentioned above in this section may be designed to remove a majority of the chloride, preferably down to below 200 ppmw in stream 19. Adsorbent system 105 is suitable to remove chloride to near zero concentration or no more than 10 ppmw in final product. Adsorbent system 105 runs with an identical backup bed to avoid chloride breakthrough. The resulting salt in adsorbent system 105 is considered as spent and is removed while the other vessel is running online. This allows the unit to be run continuously, a benefit over batch processes. Each chloride control step has an optimal chloride concentration in feed and efficiency limitation. Sorbent injection to reactor of gaseous dilution is known to come to uneconomical gain with increasing dosage when passing a certain efficiency threshold, e.g., when seeking down to a level lower than about 200-400 ppm Cl in product, excessive use of sorbent may be needed, leading to economical penalty. Adsorbent bed is more suitable and economical only as a final polish, i.e. brining chloride content from 200-400 ppm down to <~10 ppm in final product. Similarly, any chloride increase in adsorbent bed feed can lead to excessively large use of adsorbent. Therefore, among the step-wise dechlorination, it may prove sorbent injection to reactor is critical to bring chloride content from a few thousands part per million down to a couple of hundreds. However, a use of sorbent in reactor needs to be designed to remove sorbent by settling. The cleaned product stream 20 is cooled as a stream 21 and stored in product storage 108. If desired, stream 21 can be fractionated into to two or more streams according to their boiling points before being sent to storage.

The total vapor stream 13 may contain a variety of gaseous species. In particular, it may contain nitrogen, any residual moisture from the feed, hydrogen chloride, carbon dioxide from polyethylene terephthalate conversion, methane, ethane, propane, ethylene, propylene and heavier hydrocarbon vapors from plastic pyrolysis reaction. The heat value as quite high, frequently on the order of 30,000 KJ/kg. The burning of the gas is necessary before gas cleanup, but it also provides a useful heat source for the process. The heat of combustion is utilized in the heat exchanger built into unit 106. After incineration, the off-gas stream 22 is sent to a clean-up system 107 where any dioxin is removed in a carbon bed and hydrogen chloride is scrubbed out either using caustic, sodium bicarbonate or other materials that react with HCl.

Figure 2B:
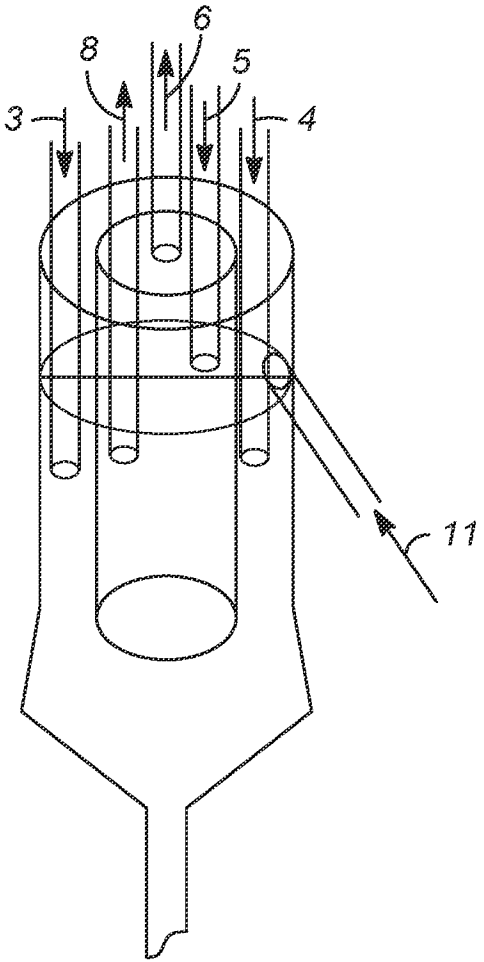
FIG. 2 is a schematic diagram of a reactor system for pyrolyzing a mixed plastic stream in conjunction with the in accordance with an exemplary embodiment.
Figure 2A:
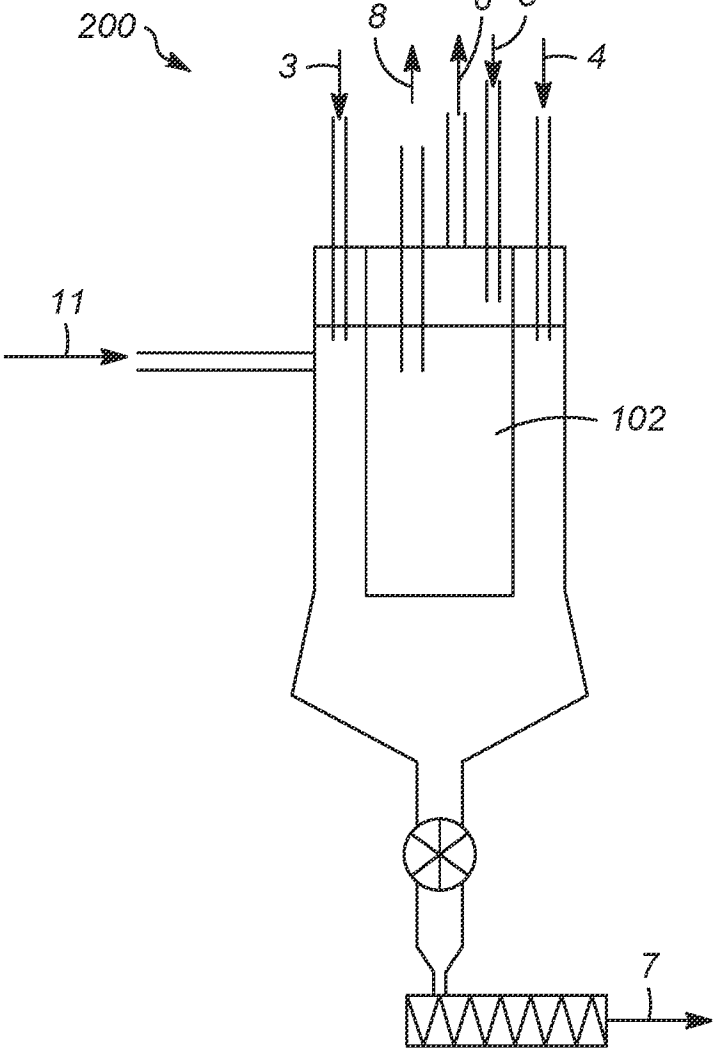

FIG. 2, showing apparatus 200, provides a detailed configuration for the pyrolysis reactor 102 which has several different features from prior art pyrolysis reactors. The pyrolysis reactor 102 may be maintained at a constant liquid level. Pyrolysis reactor 102 may have a cylindrical shape, with an internal cylinder mechanically designed to fit the circular shape of the reactor. The internal cylinder may be constructed with a section above the liquid level but with most of the cylinder submerged in the liquid reactor. In one embodiment, the internal cylinder is eccentric thus the internal cylinder wall overlaps with reactor cylinder on one side. In another embodiment, the internal cylinder is concentric thus the internal cylinder is placed in the center of main reactor. The heat of reaction in pyrolysis reactor 102 is about 2-3 fold higher than the heat of reaction in the melting reactor. After pyrolysis, polymer molecules are significantly cracked to the product molecules. Smaller product molecules mostly leave as the second vapor stream 6 at the pyrolysis reactor top. Product vapor stream 6 leaves quickly with the assistance of sweeping gas 4 that helps to drive liquid product vaporization to avoid excessive secondary cracking. Sweeping gas 4 also helps reduce the partial pressure of light hydrocarbons in the pyrolysis reactor 102. Secondary cracking is a term to describe primary pyrolysis products being cracked further through additional residence time under pyrolysis condition. The latent heat requirement to vaporize the product and provide the heat of reaction for the pyrolysis reaction is all supplied by heat carried from stream 11. In one embodiment, stream 11 enters reactor as a jet that delivers momentum in a tangential direction through an annular location between an internal cylinder and an external cylinder at the upper portion of reactor. Polymer melt-rich stream 3 and sorbent stream 5 are all introduced at annular area. All feed streams mix while turning swirl-like and traveling down within the reactor. Feed polymer also is also cracked while being mixed in the hot liquid. Sorbent stream 5 has two main benefits. When the sorbent is thoroughly mixed in the pyrolysis reactor, it reacts with chloride-containing molecules all cross the liquid reaction space to form a salt which is removed in the bottom of the reactor. A sorbent may work as a flocculant serve as a seed that binds char particles to form bigger particles. Bigger particles separate better under the centripetal force and long residence the internal cylinder wall area provides. All solid particles, including char particles greater than a certain size cut, e.g., 150 micrometers, sorbent, metals carried from the feed, metal or alkaline metals from plastic additives travels along wall area while liquid turns up from the center upward through internal cylinder. Entire scheme behaves as a hydrocyclone separator but with cracking reaction occurring. Solid-lean liquid stream turn upward to the free liquid surface. Liquid stream 8 may be drawn from a submerged pipe that connects to a circulation pump in FIG. 1 to heater 106. A vapor stream 6 may be drawn from the vapor space to separator 103 in FIG. 1, or preferably through an assisting gas sweeping stream 4 that is introduced into vapor space. It is preferred to expand reactor volume along the lower bottom skirt area of the external cylinder. There are a range of optimal angles between vertical and inclined wall. The optimal design allows a max separation of solids of the least density such as char in a certain size cut, e.g., 150 micrometers achieves a max fractionation being separated to the bottom relative to its total mass in combined feed stream into the annular. A total of 70-80% efficiency can be achieved with proprietary calculation methods for a carbonaceous particle size in 150 micrometers with 1.5 g/cc density in a representative pyrolysis reactor system. The disclosed reactor scheme has a surprisingly solid separation efficiency than any other reactor configuration for the same transport objective.

Figure 3B:
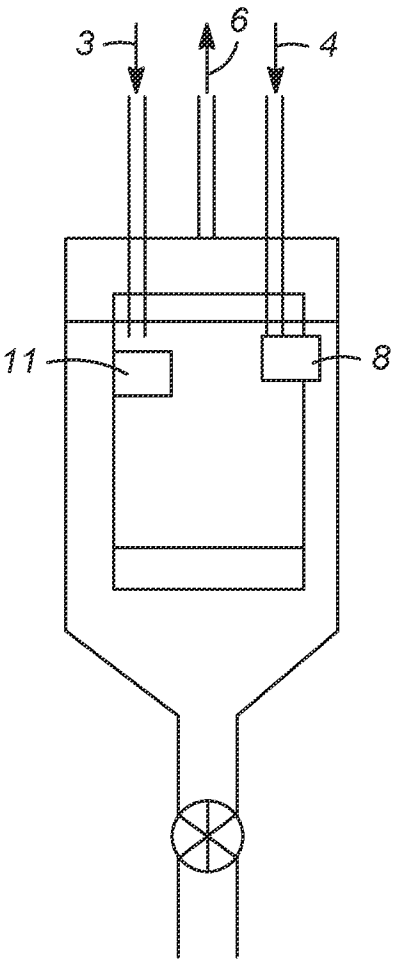
FIGS. 3A, 3B and 3C is a schematic diagram of an alternative reactor system for pyrolyzing a mixed plastic stream in conjunction with the in accordance with an exemplary embodiment.
Figure 3A:
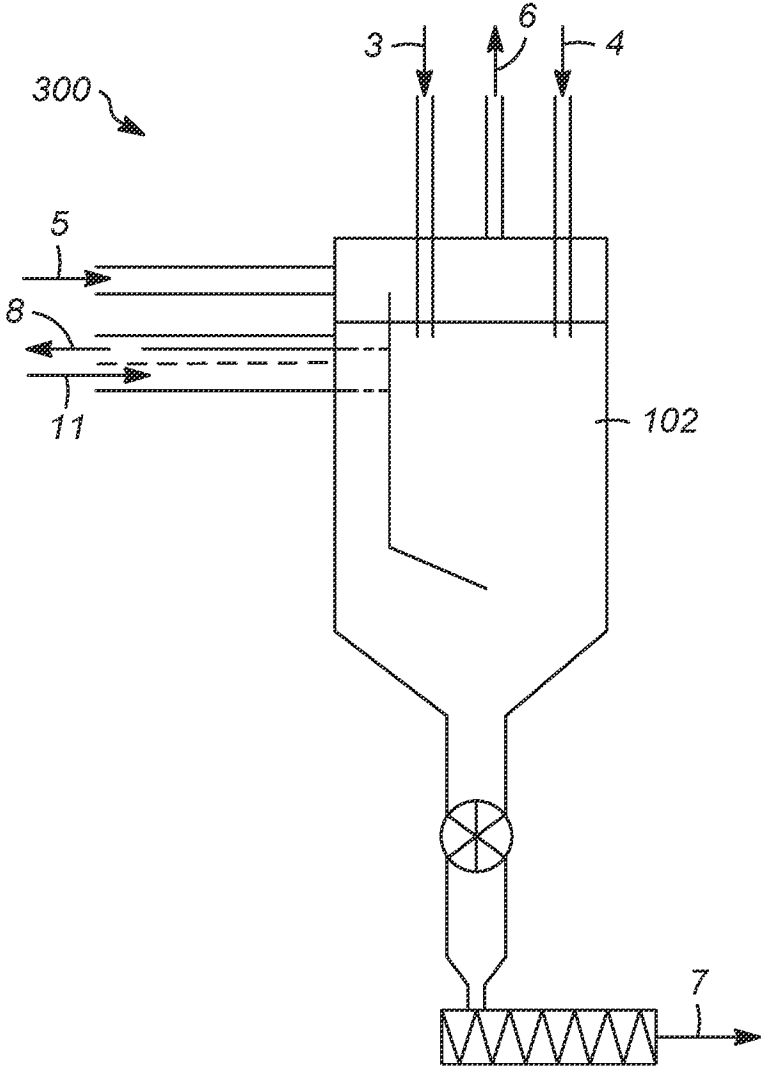
Figure 3C:
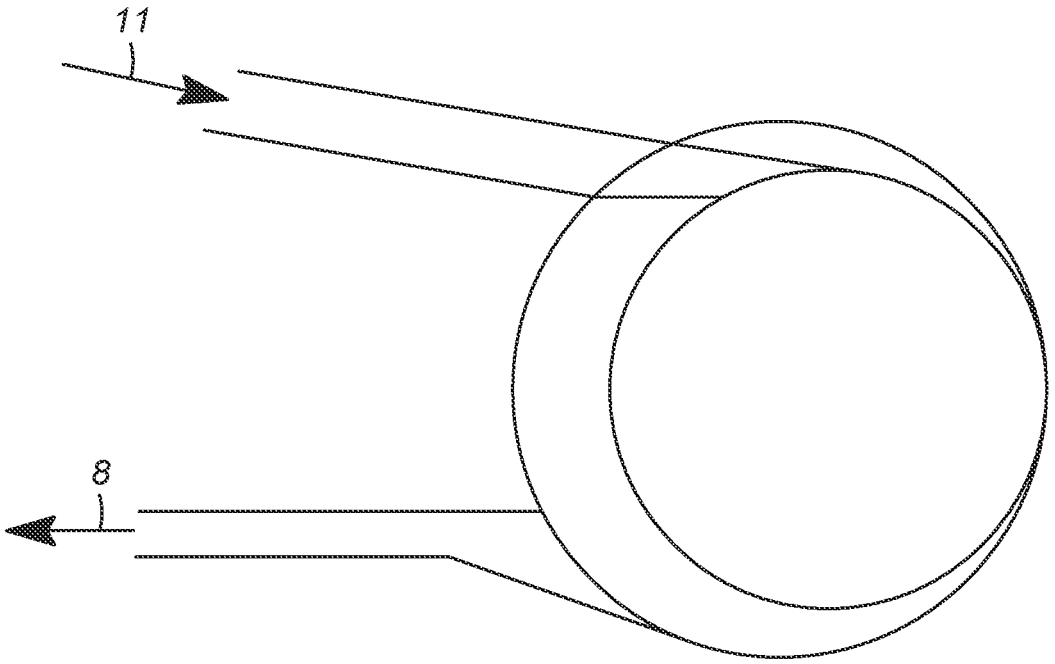

In another embodiment, alternative options exist. A two-cylinder reactor set-up shown in FIG. 3 further disclose that the stream 11 may enter the reactor through internal cylinder wall edge and enters a tapered pipe to further increase the velocity 2-10 times higher than seen in the upstream pipe. This momentum is illustrated in the portion broken out above reactor 102. Polymer melt rich stream 3 and sorbent stream 6 are quickly mixed due to the turbulence generated by the tapered pipe. Both mass and heat flows are mixed vigorously. In the alternative reactor scheme, the particles travel downwards to the tip of one side of the internal cylinder or to the conical wall area of main reactor wall. The particles are then collected at the reactor bottom stream. In the alternative reactor scheme shown in FIG. 3, on the side of pyrolysis reactor 102 between the internal wall and external main reactor wall, a stream 8 may be pumped out as the circulation stream. The draw location is ideally located at the upper liquid level section. The reactor liquid when traveling from the lower tip of the internal cylinder and travels back to the draw location. At the bottom a tapered angle between internal cylinder wall and external cylinder wall may be provided such that it does not accelerate solids in bottom cone to the draw location. The alternative reactor scheme may be lower in separation efficiency by ~10-30% depending on design details. Both FIG. 2 and FIG. 3 represent a two-cylinder design for pyrolyzing waste plastic while separating solid particles. Both have surprisingly high solid separating efficiency in comparison with any prior art known to the authors relative to the most difficult to separate carbonaceous char particles, e.g. in 150 micrometer in size and 1.5 g/cc density as a demonstrated example. The invention may not be limited to the two teaching configurations. It may cover a range of dimensional variations along the two-cylinder reactor design.

In either of the disclosed well mixed pyrolysis reactor schemes the solid content is highly concentrated. In an example, there is a 3-5% char yield based on freshly fed polymer melt. The char is further concentrated in the bottom solid-liquid discharge mix as a vapor product is taken from the reactor. Frequently, solids are concentrated by tens of fold compared to product yield. This applies to any type of solid discussed above. The highly concentrated solids at the reactor bottom due to enhanced separation or settling may be further taken by a device that handles streams containing high concentrations of solids. An example of the device can be a rotary valving device followed by an auger. The bottom stream may contain highly concentrated solids from inorganic metal, spent sorbent, chloride salt and/or carbonaceous char.

Figure 4:
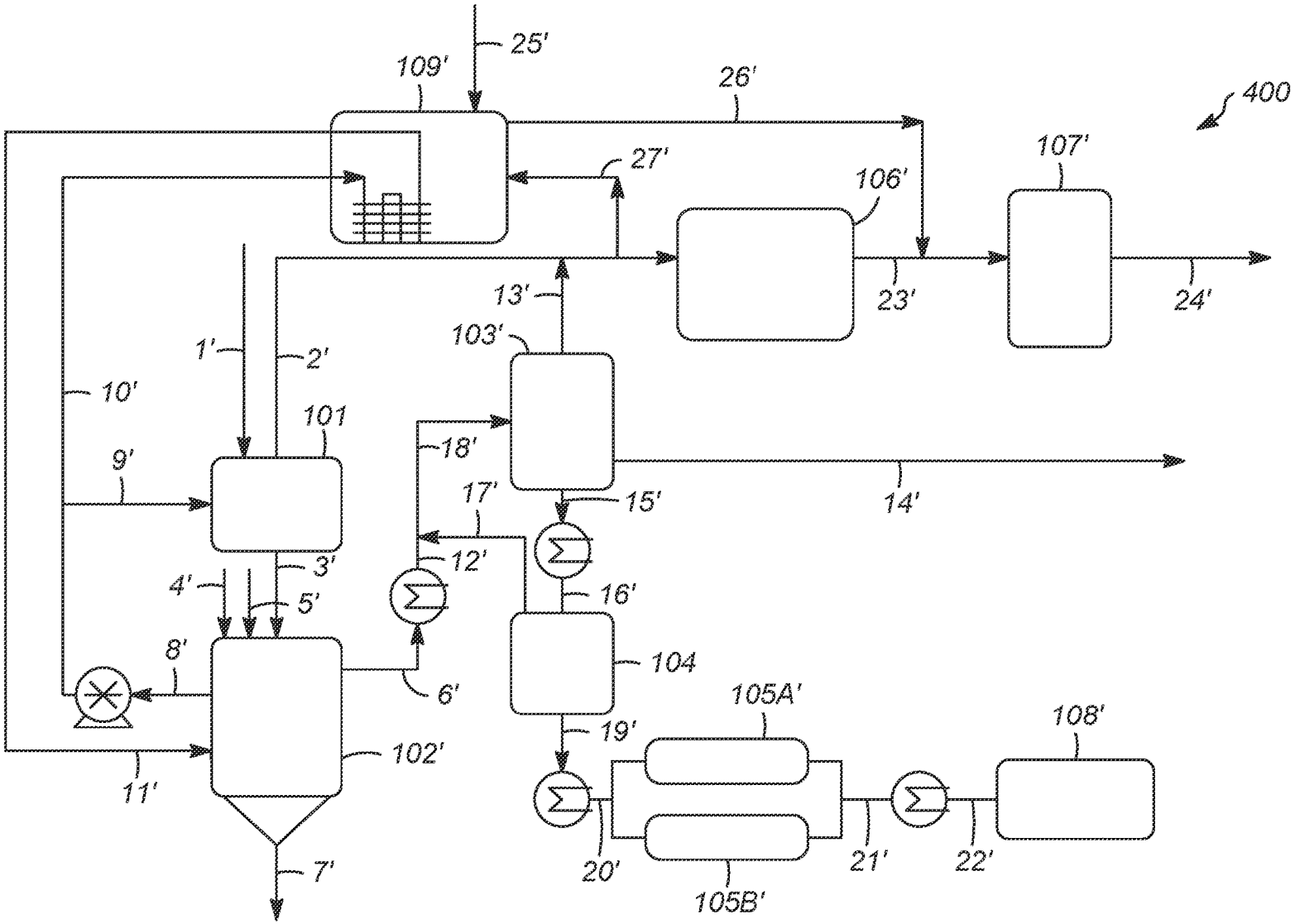
FIG. 4 is a schematic diagram of alternative process and an apparatus for pyrolyzing a mixed plastic stream in accordance with an exemplary embodiment.

FIG. 4 is a modification on the embodiment shown in FIG. 1. All of the element numbers are shown with a quote mark to show that with few exceptions the element numbers have the same meaning as in FIG. 1. The main difference is that there is a separate fired heater 109' that burns a liquefied petroleum gas or natural gas to heat up recirculation oil stream 10'. Further the fired heater off-gas stream 26' may be further combined with incinerator off-gas clean up. Further the reactor off-gas streams 2' and 13' may be blended and split a sub stream 27' to supplement fuel consumption in 109'.

In an embodiment, a two-cylinder reactor set-up shown in FIG. 1 that discloses that stream 3 may enter the reactor through internal cylinder wall edge and enters a tapered pipe to further increase the velocity 2-10 times higher than seen in the upstream pipe. This momentum is illustrated in the portion broken out above reactor 102. Polymer melt rich stream 3 and sorbent stream 6 are quickly mixed due to the turbulence generated by the tapered pipe. Both mass and heat flows are mixed vigorously. In the alternative reactor scheme, the particles travel downwards to the tip of one side of the internal cylinder or to the conical wall area of main reactor wall. The particles are then collected at the reactor bottom stream. In the alternative reactor scheme shown in FIG. 3, on the side of pyrolysis reactor 102 between the internal wall and external main reactor wall, a stream 8 may be pumped out as the circulation stream. The draw location is ideally located at the upper liquid level section. The reactor liquid when traveling from the lower tip of the internal cylinder and travels back to the draw location. At the bottom a tapered angle between internal cylinder wall and external cylinder wall may be provided such that it does not accelerate solids in bottom cone to the draw location. The alternative reactor scheme may be lower in separation efficiency by ~10-30% depending on design details. Both FIG. 2 and FIG. 3 represent a two-cylinder design for pyrolyzing waste plastic while separating solid particles. Both have surprisingly high solid separating efficiency in comparison with any prior art known to the authors relative to the most difficult to separate carbonaceous char particles, e.g. in 150 micrometer in size and 1.5 g/cc density as a demonstrated example. The invention may not be limited to the two teaching configurations. It may cover a range of dimensional variations along the two-cylinder reactor design.

In either of the disclosed well mixed pyrolysis reactor schemes the solid content is highly concentrated. In an example, there is a 3-5% char yield based on freshly fed polymer melt. The char is further concentrated in the bottom solid-liquid discharge mix as a vapor product is taken from the reactor. Frequently, solids are concentrated by tens of fold compared to product yield. This applies to any type of solid discussed above. The highly concentrated solids at the reactor bottom due to enhanced separation or settling may be further taken by a device that handles streams containing high concentrations of solids. An example of the device can be a rotary valving device followed by an auger. The bottom stream may contain highly concentrated solids from inorganic metal, spent sorbent, chloride salt and/or carbonaceous char.

A two-step mixed plastic waste pyrolysis process for pyrolyzing a polyvinyl chloride containing waste stream with a metal and char product is provided. The process for pyrolyzing a plastic waste stream is addressed with reference to a process and an apparatus 100 according to an embodiment as shown in FIG. 1. Referring to FIG. 1, the process and apparatus 100 comprise a melting reactor 101, a pyrolysis reactor 102, separation units 103 and 104, an adsorbent bed section 105, a waste gas burning and oil heat exchanger section (also referred to as incinerator) 106, a gas cleaning section 107 and finally a product designation section that has optional fractionation and storage 108.

In an embodiment, the mixed plastic residue stream may comprise miscellaneous plastic waste comprising at least seven types of plastic classes, polyethylene terephthalate, low-density and high-density polyethylene, polypropylene, polyvinyl chloride, polystyrene and other miscellaneous plastics. The US Environmental Protection Agency reported in Advancing Sustainability Material Management: 2016 and 2017 Tables and Figures shows on US average that 3% polyvinyl chloride, 13% polyethylene terephthalate, 7% polystyrene and 11% other plastic and undefined ended up in 2017 waste plastic mix going to landfills. Relative amounts of each plastic type vary depending on the location of collection of recycled plastic.

Other miscellaneous plastics may originate from a variety of post-consumer products, including, acrylonitrile butadiene styrene found in electronic waste, polyurethane foam packaging, carpet nylon and polysulfone. The mixed plastic residue stream is also commonly known as containing impurities such as paper, wood, aluminum foil, some metallic conductive fillers or halogenated or non-halogenated flame retardants. During a pyrolysis reaction, some of these impurities may contribute to heteroatoms in product streams. Among all heteroatom in main products chloride originated from polyvinyl chloride is the most concerning for quality due to its link to metallurgy corrosion. Some contribute to more char formation due to the aromatic structure in polymer molecules. Some decompose out of the plastic molecular matrix and form particulate byproduct containing metals and alkaline earth metals.

In an embodiment, the mixed plastic waste at the processing end of a mechanical recycling facility (MRF) that is otherwise sent to a landfill is used for pyrolysis feedstock. In FIG. 1, the mixed feed stream is received with minimal sorting at the MRF site and is added in the system as a densified flake or a pellet. Mixed feed stream 1 is added to melting reactor 101. When mixed plastic waste is being pyrolyzed, 1 wt % polyvinyl chloride produces ~5800 ppmw hydrogen chloride in theory on a fresh feed rate basis. A mixed feed stream with minimal sorting may contain >2% wt PVC in it. Cold mixed plastic fluff mixes with a hot liquid stream 8 to reach a temperature of 300-350° C.

The melting reactor 101 functions as a dechlorination reactor and may operate at a temperature from about 200° C. (392° F.) to about 350° C. (662° F.), or preferably about 280° C. (536° F.) to about 320° C. (608° F.), a pressure from about 0.069 MPa (gauge) (10 psig) to about 1.38 MPa (gauge) (200 psig), or preferably about 0.138 MPa (gauge) (20 psig) to about 0.345 MPa (gauge) (50 psig), a liquid hourly space velocity of the fresh melt feed from about 0.1 $hr^{-1}$ to about 2 $hr^{-1}$, or preferably from about 0.2 $hr^{-1}$ to about 0.5 $hr^{-1}$, and under a nitrogen blanket or a dedicated nitrogen sweeping rate of about 1.7 $Nm^3/m^3$ (10 scf/bbl) to about 170 $Nm^3/m^3$ of plastic melt (1,000 scf/bbl), or preferably about 17 $Nm^3/m^3$ (100 scf/bbl) to about 850 $Nm^3/m^3$ plastic melt (500 scf/bbl) In the melting reactor 101 polyvinyl chloride is mostly pyrolyzed through an "unzipping" reaction where chloride molecules are easily removed through a pyrolysis free radical reaction and abstract hydrogen in nearby sites to form hydrogen chlorides. The temperature of the melting reactor 101 is selected to melt the majority of plastic components yet barely reach their cracking temperature to maximize yield of hydrogen chlorides and minimize the amount of reactive olefins formed. Melting reactor is equipped with a mixer to keep the plastic melt well mixed until melting is the mostly complete. The melting reactor may still leave a fraction of feed chloride unconverted. This chloride requires a few downstream steps to meet product quality requirement. A reasonable dechlorination conversion efficiency in the melting reactor is 90%, or from around 80 to around 98% within conditions specified above. Any organochlorides left in the melting reactor bottoms lead to the formation of hydrogen chloride in the pyrolysis reactor, so organochlorides and any hydrogen chloride trapped in pyrolysis oil is detrimental to downstream processing unit metallurgy and requires additional sorbent addition. In this invention, the product quality target is less than 10 ppmw chloride or less regardless of chloride content in the feed.

The melting reactor forms a first vapor stream 2 and a first liquid stream 3 from feed 1. The first liquid stream 3 contains a mixed plastic melt, with most of chloride removal in vapor stream 2. First liquid stream 3 is sent to the main pyrolysis reactor 102. The main pyrolysis reactor provides enough residence time for all mixed plastic to convert first liquid stream 3 to a designated product slate. The main pyrolysis reactor may operate at a temperature from about 300° C. (572° F.) to about 550° C. (1022° F.), or preferably about 380° C. (716° F.) to about 450° C. (842° F.), a pressure from about 0.069 MPa (gauge) (10 psig) to about 1.38 MPa (gauge) (200 psig), or preferably about 0.138 MPa (gauge) (20 psig) to about 0.345 MPa (gauge) (50 psig), a liquid hourly space velocity of the fresh melt feed from about 0.1 $hr^{-1}$ to about 2 $hr^{-1}$, or from about 0.2 $hr^{-1}$ to about 0.5 $hr^{-1}$ more preferably, and under nitrogen blanket or a dedicated nitrogen sweeping stream 4 at a rate of about 17 $Nm^3/m^3$ (100 scf/bbl) to about 850 $Nm^3/m^3$ plastic melt (5,000 scf/bbl), or about 170 $Nm^3/m^3$ (1000 scf/bbl) to about 340 $Nm^3/m^3$ plastic melt (2000 scf/bbl) more preferably. Nitrogen sweeping stream 4 serves as a dilution to hydrogen chloride partial pressure in total vapor product. Lowered hydrogen chloride partial pressure significantly reduces formation of organochloride by reducing the equilibrium constant. A finely ground solid sorbent stream 5 may be introduced to the feed at the top of the pyrolysis reactor 102. Sorbents chosen may include naturally occurring alkaline materials, e.g. calcium carbonate, quick lime, or calcium hydroxide. Calcium dosage is ideally in a 2-3 molar ratio to the chlorides left in the pyrolysis reactor feed. The previous dechlorination step in melting reactor 101 should have removed at least 80 wt % of the chloride in the mixed plastic feed. The alkaline sorbent dosage is based on the feed chloride content and the estimated chloride removal efficacy. Calcium may also have a flocculation effect, making carbonaceous char particles agglomerate around seeding of calcium particles. The flocculated particles will settle more easily in the pyrolysis reactor than unflocculated char particles. The pyrolysis reactor contains liquid in phase equilibrium with the vapor product stream. A portion of the liquid stream 8 may be sent to a circulation pump. The pumped stream may be split off to stream 9 and stream 10. The mass flow of stream 9 may be such that it sustains the melting reactor temperature as described above by mixing with the melted plastic. Stream 9 also may serve to reduce the polymer melt viscosity. The mass flow of stream 10 may be such that it obtains all of the enthalpy requirements via the heater 106 when returning to pyrolysis reactor 102 through stream 11. Necessary heat transfer is achieved by mixing hot stream 11 and cold stream 3 in main pyrolysis reactor 102. The pyrolysis reactor 102 may draw a second vapor product stream 6 from the top of the pyrolysis reactor and a second solid rich product stream 7 from the bottom of the reactor. Convective heat transfer inside pyrolysis reactor 102 along with mixing from pumping around stream 11 provides uniform heating, an advantage over pyrolysis reaction methods heated via external indirect heating, commonly seen in extrusion or rotary kiln reactors.

FIG. 1 further illustrates vapor product flow 6, which contains a range of hydrocarbons carried by a nitrogen flow at a designed vapor linear velocity. In this invention, the linear vapor velocity is intended be greater than 0.2 inch/second to avoid secondary cracking. Vapor product flow 6 may contact a cooling medium directly or indirectly and then be separated to a vapor stream 13 and a liquid stream 15. When direct water contact is involved as one possible cooling methods, an aqueous stream is collected at stream 14. When direct water contact is omitted, stream 14 may not exist. The liquid stream 15 is further a heated stream 16 and flashed in flash drum 104 to produce a stabilized liquid stream 18. The vapor stream 17 is at a higher pressure than separator 103 and is pressured back to separator 103 to enhance recovery of hydrocarbons in the desired product. The stream is mixed with stream 12 to avoid needing multiple inlet nozzles on separator 103.

The stabilized liquid stream 19 is further cooled to a desired temperature in stream 19 before it enters an adsorbent system 105. The adsorbent system 105 runs as a further and final chloride polishing device. Calcium, other alkaline materials or a range of naturally occurring adsorbents may be used to continuously remove a large fraction of the unconverted chloride content in the condensed oil. More preferably specially engineering adsorbents with high adsorbent capacity and activity are used. Adsorbent capacity is defined as per unit of adsorbent. Adsorbent activity is defined with a lower temperature required to achieve a desired rate. Further a Honeywell UOP commercial product CLR 204 is particularly suitable for this application. As previously mentioned herein, this disclosure provides for stepwise chloride removal. Single step chloride removal may have efficiency issues in chloride removal when a mixed plastic feed has elevated PVC content, e.g., 2% or more. Melting reactor 101 first removes over 80% by weight of chloride in the mixed plastic feed by decomposing the PVC in the melting reactor. This chloride is removed as hydrogen chloride. A fraction of the remaining chloride is removed in pyrolysis reactor 102 where a sorbent is added to convert a fraction of the chloride as a salt. Unconverted hydrogen chloride is further diluted in a sweeping nitrogen flow where gas-phase recombination reactions between hydrogen chloride and organic molecules are minimized. The steps mentioned above in this section may be designed to remove a majority of the chloride, preferably down to below 200 ppmw in stream 19. Adsorbent system 105 is suitable to remove chloride to near zero concentration or no more than 10 ppmw in final product. Adsorbent system 105 runs with an identical backup bed to avoid chloride breakthrough. The resulting salt in adsorbent system 105 is considered as spent and is removed while the other vessel is running online. This allows the unit to be run continuously, a benefit over batch processes. Each chloride control step has an optimal chloride concentration in feed and efficiency limitation. Sorbent injection to reactor of gaseous dilution is known to come to uneconomical gain with increasing dosage when passing a certain efficiency threshold, e.g., when seeking down to a level lower than about 200-400 ppm Cl in product, excessive use of sorbent may be needed, leading to economical penalty. Adsorbent bed is more suitable and economical only as a final polish, i.e. brining chloride content from 200-400 ppm down to <~10 ppm in final product. Similarly, any chloride increase in adsorbent bed feed can lead to excessively large use of adsorbent. Therefore, among the step-wise dechlorination, it may prove sorbent injection to reactor is critical to bring chloride content from a few thousands part per million down to a couple of hundreds. However, a use of sorbent in reactor needs to be designed to remove sorbent by settling. The cleaned product stream 20 is cooled as a stream 21 and stored in product storage 108. If desired, stream 21 can be fractionated into to two or more streams according to their boiling points before being sent to storage.

The total vapor stream 13 may contain a variety of gaseous species. In particular, it may contain nitrogen, any residual moisture from the feed, hydrogen chloride, carbon dioxide from polyethylene terephthalate conversion, methane, ethane, propane, ethylene, propylene and heavier hydrocarbon vapors from plastic pyrolysis reaction. The heat value as quite high, frequently on the order of 30,000 KJ/kg. The burning of the gas is necessary before gas cleanup, but it also provides a useful heat source for the process. The heat of combustion is utilized in the heat exchanger built into unit 106. After incineration, the off-gas stream 22 is sent to a clean-up system 107 where any dioxin is removed in a carbon bed and hydrogen chloride is scrubbed out either using caustic, sodium bicarbonate or other materials that react with HCl.

FIG. 2, showing apparatus 200, provides a detailed configuration for the pyrolysis reactor 102 which has several different features from prior art pyrolysis reactors. The pyrolysis reactor 102 may be maintained at a constant liquid level. Pyrolysis reactor 102 may have a cylindrical shape, with an internal cylinder mechanically designed to fit the circular shape of the reactor. The internal cylinder may be constructed with a section above the liquid level but with most of the cylinder submerged in the liquid reactor. In one embodiment, the internal cylinder is eccentric thus the internal cylinder wall overlaps with reactor cylinder on one side. In another embodiment, the internal cylinder is concentric thus the internal cylinder is placed in the center of main reactor. The heat of reaction in pyrolysis reactor 102 is about 2-3 fold higher than the heat of reaction in the melting reactor. After pyrolysis, polymer molecules are significantly cracked to the product molecules. Smaller product molecules mostly leave as the second vapor stream 6 at the pyrolysis reactor top. Product vapor stream 6 leaves quickly with the assistance of sweeping gas 4 that helps to drive liquid product vaporization to avoid excessive secondary cracking. Sweeping gas 4 also helps reduce the partial pressure of light hydrocarbons in the pyrolysis reactor 102. Secondary cracking is a term to describe primary pyrolysis products being cracked further through additional residence time under pyrolysis condition. The latent heat requirement to vaporize the product and provide the heat of reaction for the pyrolysis reaction is all supplied by heat carried from stream 11. In one embodiment, stream 11 enters reactor as a jet that delivers momentum in a tangential direction through an annular location between an internal cylinder and an external cylinder at the upper portion of reactor. Polymer melt-rich stream 3 and sorbent stream 5 are all introduced at annular area. All feed streams mix while turning swirl-like and traveling down within the reactor. Feed polymer also is also cracked while being mixed in the hot liquid. Sorbent stream 5 has two main benefits. When the sorbent is thoroughly mixed in the pyrolysis reactor, it reacts with chloride-containing molecules all cross the liquid reaction space to form a salt which is removed in the bottom of the reactor. A sorbent may work as a flocculant serve as a seed that binds char particles to form bigger particles. Bigger particles separate better under the centripetal force and long residence the internal cylinder wall area provides. All solid particles, including char particles greater than a certain size cut, e.g., 150 micrometers, sorbent, metals carried from the feed, metal or alkaline metals from plastic additives travels along wall area while liquid turns up from the center upward through internal cylinder. Entire scheme behaves as a hydrocyclone separator but with cracking reaction occurring. Solid-lean liquid stream turn upward to the free liquid surface. Liquid stream 8 may be drawn from a submerged pipe that connects to a circulation pump in FIG. 1 to heater 106. A vapor stream 6 may be drawn from the vapor space to separator 103 in FIG. 1, or preferably through an assisting gas sweeping stream 4 that is introduced into vapor space. It is preferred to expand reactor volume along the lower bottom skirt area of the external cylinder. There are a range of optimal angles between vertical and inclined wall. The optimal design allows a max separation of solids of the least density such as char in a certain size cut, e.g., 150 micrometers achieves a max fractionation being separated to the bottom relative to its total mass in combined feed stream into the annular. A total of 70-80% efficiency can be achieved with proprietary calculation methods for a carbonaceous particle size in 150 micrometers with 1.5 g/cc density in a representative pyrolysis reactor system. The disclosed reactor scheme has a surprisingly solid separation efficiency than any other reactor configuration for the same transport objective.

FIG. 4 is a modification on the embodiment shown in FIG. 1. All of the element numbers are shown with a quote mark to show that with few exceptions the element numbers have the same meaning as in FIG. 1. The main difference is that there is a separate fired heater 109' that burns a liquefied petroleum gas or natural gas to heat up recirculation oil stream 10'. Further the fired heater off-gas stream 26' may be further combined with incinerator off-gas clean up. Further the reactor off-gas streams 2' and 13' may be blended and split a sub stream 27' to supplement fuel consumption in 109'.

SPECIFIC EMBODIMENTS

While the following is described in conjunction with specific embodiments, it will be understood that this description is intended to illustrate and not limit the scope of the preceding description and the appended claims.

A first embodiment of the invention is a process for pyrolysis of a mixed plastic waste stream comprising melting the mixed plastic waste stream in a melting reactor to produce a melted mixed plastic waste stream comprising at least two types of plastic including chlorine-containing plastics and other plastics to produce a first chloride-rich vapor stream and a first liquid stream; sending the first liquid stream to a pyrolysis reactor to be heated to produce a second chloride rich vapor stream and a second liquid stream wherein the pyrolysis reactor has a configuration comprising two cylindrical ring structures, an inner cylindrical ring structure within an outer cylindrical ring structure wherein a circulation liquid supply stream enters the pyrolysis reactor tangentially relative to a ring edge of the two cylindrical ring structures and wherein solid particles move in a downward direction to a bottom of the pyrolysis reactor; sending a heated stream from the pyrolysis reactor to the melting reactor and sending a second heated stream from the pyrolysis reactor to be further heated and returned to the pyrolysis reactor; and in multiple steps removing chlorides prior to producing a liquid product stream.

A second embodiment of the invention is a process for pyrolysis of a mixed plastic waste stream comprising sending the mixed plastic waste stream to a melting reactor to produce a first vapor stream that is chloride-rich and a first liquid stream; sending the first liquid stream to a pyrolysis reactor to be heated to produce a second vapor stream, a second liquid stream and solid particles wherein the pyrolysis reactor is configured with two cylindrical ring structures so that a circulation liquid supply stream enters tangentially relative to a ring edge of the cylindrical ring structure and wherein solid particles move in a downward direction within the pyrolysis reactor; sending the first vapor stream to an incinerator to remove hydrocarbons, hydrogen chlorides and alkyl chlorides and then to a gas cleaning zone to remove chlorine compounds and to heat at least a portion of the circulation supply stream as a reaction heat supply for the pyrolysis reactor; and cooling and separating the second vapor stream into a third vapor stream and a third liquid stream and then treating the third liquid stream in at least one adsorbent bed to remove chlorine containing impurities. An embodiment of the invention is one, any or all of prior embodiments in this paragraph up through the second embodiment in this paragraph further comprising sending an adsorbent to the pyrolysis reactor to remove chlorine compounds. An embodiment of the invention is one, any or all of prior embodiments in this paragraph up through the second embodiment in this paragraph wherein the melting reactor is operated at a temperature from about 200° C. (392° F.) to about 350° C. (662° F.). An embodiment of the invention is one, any or all of prior embodiments in this paragraph up through the second embodiment in this paragraph wherein the pyrolysis reactor device comprises two cylindrical ring structures where hot circulation stream enters annular area tangentially along external ring wall edge with the cold circulation stream leaves in central cylinder top, solid-rich stream leaving on bottom and the second vapor leaving at central cylinder top. An embodiment of the invention is one, any or all of prior embodiments in this paragraph up through the second embodiment in this paragraph wherein the pyrolysis reactor device comprises two cylindrical ring structures where hot circulation stream alternatively enters internal cylinder tangentially along internal ring wall edge with the cold circulation stream leaves in external cylinder draw point, solid-rich stream leaving on bottom and the second vapor leaving at central cylinder top. An embodiment of the invention is one, any or all of prior embodiments in this paragraph up through the second embodiment in this paragraph wherein the gas cleaning zone comprises a catalyst bed to remove dioxin compounds and a vessel containing caustic compounds to neutralize HCl. An embodiment of the invention is one, any or all of prior embodiments in this paragraph up through the second embodiment in this paragraph further comprising sending an adsorbent to the pyrolysis reactor to adsorb chlorine and chlorine containing compounds. An embodiment of the invention is one, any or all of prior embodiments in this paragraph up through the second embodiment in this paragraph wherein the adsorbent is an alkaline material present in about a 2-3 molar ratio to the chloride in the pyrolysis reactor. An embodiment of the invention is one, any or all of prior embodiments in this paragraph up through the second embodiment in this paragraph wherein the adsorbent further functions as a flocculation material for carbonaceous char particles formed during operation of the pyrolysis reactor. An embodiment of the invention is one, any or all of prior embodiments in this paragraph up through the second embodiment in this paragraph wherein the melting reactor is operated at a pressure from about 0.069 MPa (gauge) (10 psig) to about 1.38 MPa (gauge) (200 psig) and a liquid hourly space velocity from about 0.1 $hr^{-1}$ to about 2 $hr^{-1}$. An embodiment of the invention is one, any or all of prior embodiments in this paragraph up through the second embodiment in this paragraph wherein the melting reactor is operated under a nitrogen blanket at a dedicated nitrogen sweeping rate of about 1.7 $Nm^3/m^3$ (10 scf/bbl) to about 170 $Nm^3/m^3$ of plastic melt (1,000 scf/bbl). 13. An embodiment of the invention is one, any or all of prior embodiments in this paragraph up through the second embodiment in this paragraph wherein about 80 to 98 wt. % of chloride from the melting reactor is removed and sent in the vapor stream. An embodiment of the invention is one, any or all of prior embodiments in this paragraph up through the second embodiment in this paragraph wherein a stream of nitrogen is sent to the pyrolysis reactor to dilute hydrogen chloride partial pressure in the second vapor stream. An embodiment of the invention is one, any or all of prior embodiments in this paragraph up through the second embodiment in this paragraph further comprising sending the second vapor stream to a cooler and to a separator to produce a third vapor stream and a third liquid stream. An embodiment of the invention is one, any or all of prior embodiments in this paragraph up through the second embodiment in this paragraph wherein the third liquid stream comprises less than about 200 ppmw chloride. An embodiment of the invention is one, any or all of prior embodiments in this paragraph up through the second embodiment in this paragraph wherein the third liquid stream is sent to an adsorbent bed to remove chloride. An embodiment of the invention is one, any or all of prior embodiments in this paragraph up through the second embodiment in this paragraph wherein the pyrolysis reactor has a cylindrical shape with an internal cylinder mechanically designed to fit the circular shape of the reactor. An embodiment of the invention is one, any or all of prior embodiments in this paragraph up through the second embodiment in this paragraph wherein the heat of reaction in the pyrolysis reactor is about 2-3 times higher than the heat or reaction in the melting reactor. An embodiment of the invention is one, any or all of prior embodiments in this paragraph up through the second embodiment in this paragraph wherein the incinerator is replaced by a fired heater.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for pyrolysis of a mixed plastic waste stream comprising a. sending the mixed plastic waste stream to a melting reactor to produce a first vapor stream that is chloride-rich and a first liquid stream;

b. sending said first liquid stream to a pyrolysis reactor to be heated to produce a second chloride rich vapor stream and a second liquid stream wherein said pyrolysis reactor has a configuration comprising two cylindrical ring structures, an inner cylindrical ring structure within an outer cylindrical ring structure wherein a circulation liquid supply stream enters said pyrolysis reactor tangentially relative to a ring edge of said two cylindrical ring structures and wherein solid particles move in a downward direction to a bottom of the pyrolysis reactor;

c. sending said first vapor stream to an incinerator to remove hydrocarbons, hydrogen chlorides and alkyl chlorides and then to a gas cleaning zone to remove chlorine compounds and to heat at least a portion of said circulation supply stream as a reaction heat supply for said pyrolysis reactor, wherein said gas cleaning zone comprises a catalyst bed to remove dioxin compounds and a vessel containing caustic compounds to neutralize HCl; and d. cooling and separating said second vapor stream into a third vapor stream and a third liquid stream and then treating said third liquid stream in at least one adsorbent bed to remove chlorine containing impurities.

2. The process of claim 1 further comprising sending an adsorbent to said pyrolysis reactor to remove chlorine compounds.

3. The process of claim 1 wherein said melting reactor is operated at a temperature from about 200° C. (392° F.) to about 350° C. (662° F.).

4. The process of claim 1 wherein said pyrolysis reactor device comprises two cylindrical ring structures where hot circulation stream enters annular area tangentially along external ring wall edge with said cold circulation stream leaves in central cylinder top, solid-rich stream leaving on bottom and said second vapor leaving at central cylinder top.

5. The process of claim 1 wherein said pyrolysis reactor device comprises two cylindrical ring structures where hot circulation stream alternatively enters internal cylinder tangentially along internal ring wall edge with said cold circulation stream leaves in external cylinder draw point, solid-rich stream leaving on bottom and said second vapor leaving at central cylinder top.

6. The process of claim 1 further comprising sending an adsorbent to said pyrolysis reactor to adsorb chlorine and chlorine containing compounds.

7. The process of claim 6 wherein said adsorbent is an alkaline material present in about a 2-3 molar ratio to the chloride in said pyrolysis reactor.

8. The process of claim 6 wherein said adsorbent further functions as a flocculation material for carbonaceous char particles formed during operation of the pyrolysis reactor.

9. The process of claim 1 wherein said melting reactor is operated at a pressure from about 0.069 MPa (gauge) (10 psig) to about 1.38 MPa (gauge) (200 psig) and a liquid hourly space velocity from about 0.1 hr-1 to about 2 hr-1.

10. The process of claim 1 wherein said melting reactor is operated under a nitrogen blanket at a dedicated nitrogen sweeping rate of about 1.7 Nm3/m3 (10 scf/bbl) to about 170 Nm3/m3 of plastic melt (1,000 scf/bbl).

11. The process of claim 1 wherein about 80 to 98 wt. % of chloride from said melting reactor is removed and sent in said vapor stream.

12. The process of claim 1 wherein a stream of nitrogen is sent to said pyrolysis reactor to dilute hydrogen chloride partial pressure in said second vapor stream.

13. The process of claim 1 further comprising sending the second vapor stream to a cooler and to a separator to produce a third vapor stream and a third liquid stream.

14. The process of claim 13 wherein said third liquid stream comprises less than about 200 ppmw chloride.

15. The process of claim 13 wherein said third liquid stream is sent to an adsorbent bed to remove chloride.

16. The process of claim 13 wherein said pyrolysis reactor has a cylindrical shape with an internal cylinder mechanically designed to fit the circular shape of the reactor.

* * * * *